US009846411B2

(12) United States Patent
Denden

(10) Patent No.: US 9,846,411 B2
(45) Date of Patent: Dec. 19, 2017

(54) ADJUSTABLE SNOOZE TIMER FOR MECHANICAL WATCHES

(71) Applicant: Blancpain SA, Le Brassus (CH)

(72) Inventor: Mehdi Denden, Les Rousses (FR)

(73) Assignee: Blancpain SA, Le Brassus (CH)

( * ) Notice: Subject to any disclaimer, the term of this patent is extended or adjusted under 35 U.S.C. 154(b) by 0 days.

(21) Appl. No.: 15/274,494

(22) Filed: Sep. 23, 2016

(65) Prior Publication Data

US 2017/0115638 A1 Apr. 27, 2017

(30) Foreign Application Priority Data

Oct. 21, 2015 (EP) ..... 15190808

(51) Int. Cl.

| | |
|---|---|
| ***G04B 23/03*** | (2006.01) |
| ***G04B 23/06*** | (2006.01) |
| ***G04B 23/12*** | (2006.01) |
| ***G04C 21/16*** | (2006.01) |
| ***G04B 23/02*** | (2006.01) |
| ***G04F 3/02*** | (2006.01) |

(52) U.S. Cl.

CPC ..... *G04C 21/16* (2013.01); *G04B 23/026* (2013.01); *G04B 23/03* (2013.01); *G04B 23/06* (2013.01); *G04B 23/12* (2013.01); *G04F 3/02* (2013.01)

(58) Field of Classification Search

CPC ..... G04B 23/00; G04B 23/02; G04B 23/03; G04B 23/06; G04B 23/12; G04F 3/02

See application file for complete search history.

(56) References Cited

U.S. PATENT DOCUMENTS 2,946,182 A * 7/1960 Boyles ..... G04B 21/027 368/263

3,192,699 A * 7/1965 Stout ..... G04B 23/06 368/246

(Continued)

FOREIGN PATENT DOCUMENTS

| | | |
|---|---|---|
| CH | 263708 | 9/1949 |
| DE | 1 731 481 | 4/1956 |
| FR | 1 235 290 | 7/1960 |

OTHER PUBLICATIONS

European Search Report dated Feb. 2, 2016 in European application 15190808.4, filed on Oct. 21, 2015 (with English Translation of Categories of Cited Documents).

*Primary Examiner* — Vit W Miska

(74) *Attorney, Agent, or Firm* — Oblon, McClelland, Maier & Neustadt, L.L.P.

(57) ABSTRACT

A mechanical timer for setting a snooze time for an alarm mechanism controlling a mechanical actuator cooperating with a striking mechanism controlled by a timepiece movement, including a first control able to be actuated at a first moment by a user during the playing of an alarm chime to disengage the actuator and momentarily stop the chime, and including a timer arranged to automatically cause the alarm chime to play again at a second moment, after a predefined duration from the first moment, this timer including a second control able to be actuated by a user to set this predefined duration, and a release cam indirectly controlled by the first control and arranged to control the pivoting of a hammer lever, which, depending on its angular position, releases or locks the actuator to allow or respectively prevent the playing of an alarm chime.

12 Claims, 6 Drawing Sheets

(56) References Cited

U.S. PATENT DOCUMENTS

| | | | | |
|---|---|---|---|---|
| 3,261,157 | A | 7/1966 | Turel et al. | |
| 3,733,802 | A * | 5/1973 | Wisser | G04B 23/10 368/248 |

* cited by examiner

ADJUSTABLE SNOOZE TIMER FOR MECHANICAL WATCHES

This application claims priority from European Patent Application No 15190808.4 of Oct. 21, 2015 the entire disclosure of which is hereby incorporated herein by reference.

FIELD OF THE INVENTION

The invention concerns an alarm mechanism arranged to control the motion of at least one mechanical actuator cooperating with a striking mechanism controlled by a timepiece movement, and comprising a timer for setting a snooze time, wherein said timer is entirely mechanical and includes first control means able to be actuated at a first moment by a user during the playing of an alarm chime in order to disengage said actuator and momentarily stop said alarm chime, and in that said timer includes mechanical timing means arranged to automatically cause said alarm chime to play again at a second moment, after a predefined duration from said first moment.

The invention also concerns a watch including such a timer.

BACKGROUND OF THE INVENTION

When an alarm mechanism emits an alarm signal, particularly via a striking mechanism, a snooze function makes it possible to stop the alarm and then release the alarm again after a short time. This function is only present in electronic timepieces.

FR Patent Application 1235290A in the name of GÜNTER HEMPEL discloses a repeater alarm wherein striking is eliminated by a toothed wheel mounted on the minute arbor and which repeater alarm can be locked in the stop position.

SUMMARY OF THE INVENTION

The mechanism according to the invention makes it possible to incorporate such a snooze function, which can be adjusted in steps of predefined durations, particularly 5 minutes, and actuated by the user, in a watch already fitted with an alarm mechanism.

The invention therefore concerns an alarm mechanism comprising a timer for setting a snooze time according to claim 1.

The invention also concerns a watch including such a timer.

BRIEF DESCRIPTION OF THE DRAWINGS

Other features and advantages of the invention will appear upon reading the following detailed description, with reference to the annexed drawings, in which:

FIG. 4: contact between the control click and a rack pin.

FIG. 5: contact between this click and a contact lever jumper pin.

FIG. 6: retraction of the control click.

DETAILED DESCRIPTION OF PREFERRED EMBODIMENTS

Figure 1:
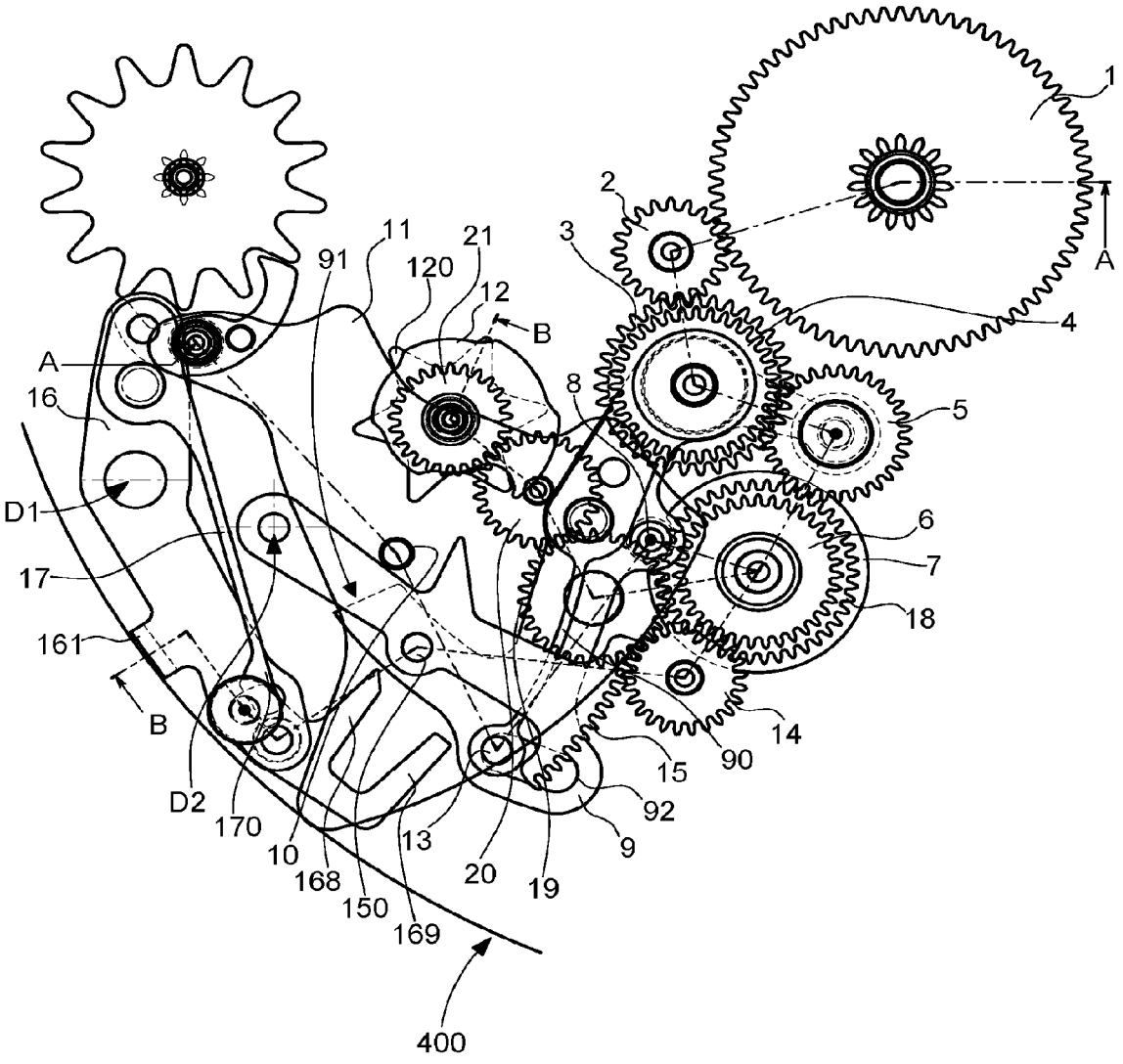
FIG. 1 shows a schematic plan view of the snooze timer mechanism according to the invention, added to an alarm mechanism.

The invention concerns a timer 100 for setting a snooze time, devised to be incorporated in or added to an alarm mechanism 200 known to those skilled in the art, arranged to control the motion of at least one mechanical actuator 11 cooperating with a striking mechanism 300 controlled by a timepiece movement 400.

According to the invention, this timer 100 is entirely mechanical.

In a preferred embodiment illustrated in the Figures, this timer 100 comprises first control means, which can be actuated, at a first moment, by a user during the playing of an alarm chime in order to disengage actuator 11 and momentarily stop the alarm chime. This timer 100 includes mechanical timing means, which are arranged to automatically cause the alarm chime to play again at a second moment, after a predefined duration from the first moment.

FIG. 1 illustrates the whole of mechanism 100; the alarm release mechanism is not represented. The contour of movement 400 is symbolised by a simple arc of a circle in the Figures.

Figure 2:
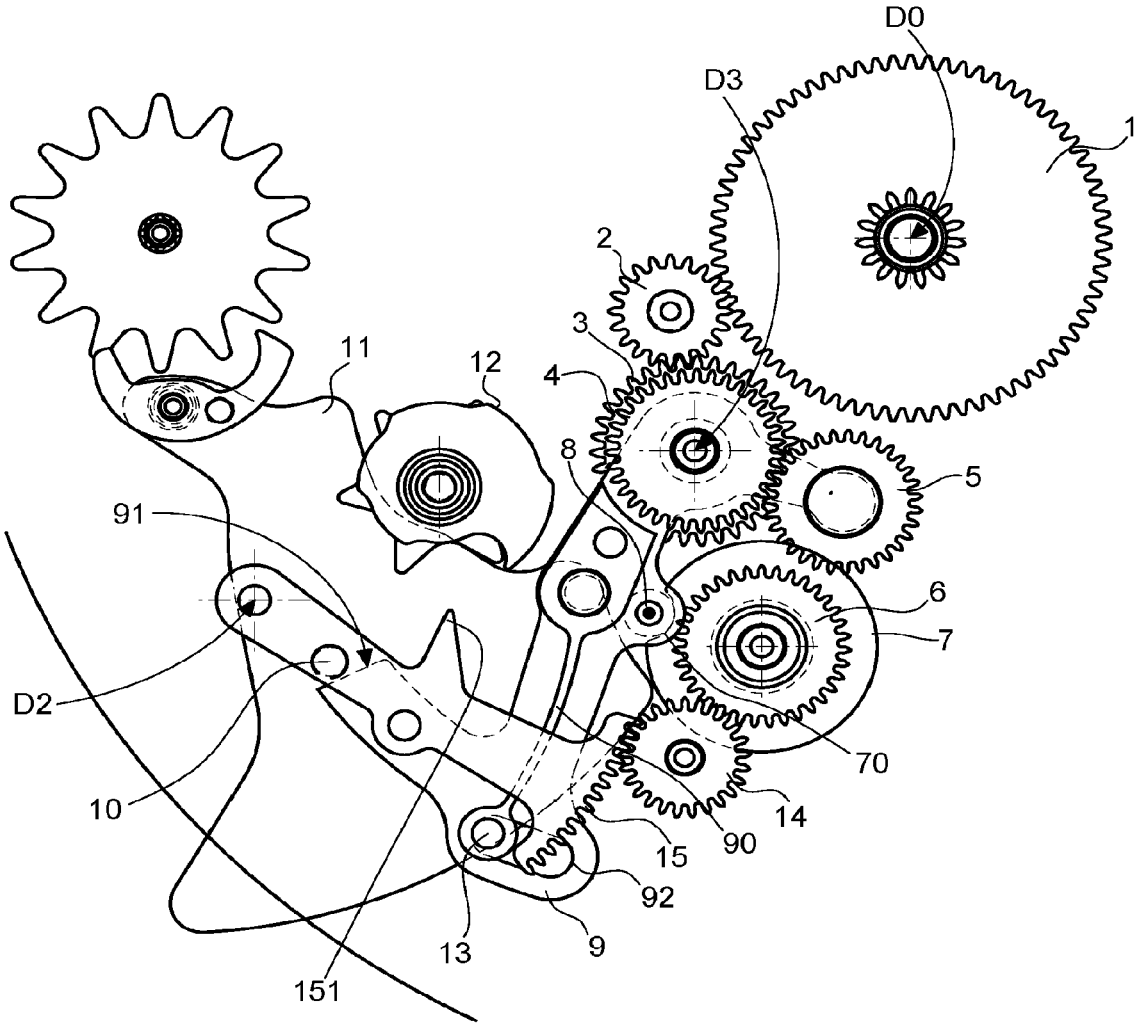
FIG. 2 represents a part of the mechanism of FIG. 1 during the alarm chime, at the stage at which the snooze function can be started.

FIG. 2 represents a part of mechanism 100 during the playing of the alarm chime, at the stage at which the snooze function can be started.

When the alarm chimes, an actuator 11 is released and moves, along arrow F in FIG. 2, to strike a gong, not represented in the Figures, preferably but not restrictively fixed to the exterior of timepiece movement 400 which cooperates with a striking mechanism 300 and such an alarm mechanism 200.

In the embodiment illustrated, actuator 11 is an alarm hammer, and the present description concerns this non-limiting variant. The invention is, of course, applicable to any other form of actuator for a striking-mechanism.

Timer 100 includes a release cam 7, which is controlled, directly, or indirectly as in the embodiment illustrated in the Figures, by the first control means. This release cam 7 is arranged to control the pivoting of a hammer lever 9, comprised in timer 100. Depending on its angular position, hammer lever 9 releases or locks actuator 11, to allow or respectively prevent an alarm chime playing.

The invention allows the user to choose between letting the alarm chime finish completely, or deactivating the alarm via an ordinary mechanism, or starting a snooze function specific to the invention, using the first control means.

These first control means include a first push-piece 161 arranged to be actuated by the user, and to cause a control lever 16 to pivot. This first control lever 16 is arranged, when pivoting under the action of a user, to control the pivoting of a rack 15 which is arranged to drive release cam 7.

In the particular variant illustrated by the Figures, control lever 16 includes for this purpose a control click 160, which allows activation of the snooze function, and which is mounted on control lever 16 and articulated thereto, and returned by at least one spring 17.

When control lever 16 pivots about its axis D1, control click 160 pushes a rack 15 which pivots about an axis D2, by means of a rack pin 150 which is integral with said rack 15.

Control click 160 includes a first end bearing surface 162, which is arranged to push rack pin 150 so as to pivot rack 15, and a second end bearing surface 163 arranged to push a pin 13 comprised in a lever jumper 90, which is integral with hammer lever 9. This hammer lever 9 includes an oblong hole 92 in which is movable pin 13, which tends to push control click 160 back outwardly from movement 400, into a position where the user can operate the first control means.

More particularly, control click 160 includes, between said first end bearing surface 162 and the articulation with control lever 16, a side bearing surface 165 receiving and supporting rack pin 150, and, between first end bearing surface 162, and second end bearing surface 163, a recess 164 allowing control click 160 to retract when the first control means are operated in the end of travel position by the user.

More particularly, first control lever 16 is articulated to control click 160 by means of a pin 166 movable in an oblong hole 167, and returned towards the exterior of movement 400 by said spring 17.

The first degrees of rotation of rack 15 allow a hammer lever 9 to be raised, via an intermediate rack wheel 14, then a cam release wheel 6, which is integral with a release cam 7, then a roller 8 which is arranged to cooperate with a notch 70 in release cam 7.

Hammer lever 9 may, depending on its angular position, either lock alarm hammer 11, by engaging in abutment, via a stop surface 91 comprised therein, on a pin 10 which is integral with alarm hammer 11, or allow the travel of the alarm hammer.

Hammer lever 9 carries a disengagable wheel 5, on the side opposite to that of stop surface 91 for the embodiment illustrated in the Figures. Disengagable wheel 5 meshes with a gear train of movement 400 via a friction spring 30. Disengagable wheel 5 can occupy a first position of mesh with a release cam wheel 6 integral with release cam 7, this first position of mesh corresponding to an angular position wherein hammer lever 9 locks actuator 11, and a second out-of-mesh position with release cam wheel 6, this second out-of-mesh position corresponding to an angular position wherein hammer lever 9 allows actuator 11 free passage.

When hammer lever 9 pivots about its axis D3 to lock hammer 11, disengagable wheel 5 connects cam wheel 6 to a cannon-pinion 1 via second 2, third 3 and fourth 4 intermediate wheels.

At this stage, rack 15 has not yet finished its travel. Indeed, rack 15 continues to pivot until it bears, via a beak 151 comprised therein, on a duration cam 12. While pivoting, rack 15 drives release cam 7, release cam wheel 6 and disengagable wheel 5.

It is understood that the angle of rack 15, when it drops, determines the duration.

According to the invention, timer 100 comprises second control means actuatable by a user to adjust the predefined snooze time duration.

To this end, rack 15 comprises a beak 151, which is arranged to bear on a cam track comprised in duration cam 12, which preferably has a plurality of tracks each corresponding to a particular duration of time enabling the user to set the predefined duration.

Figure 7:
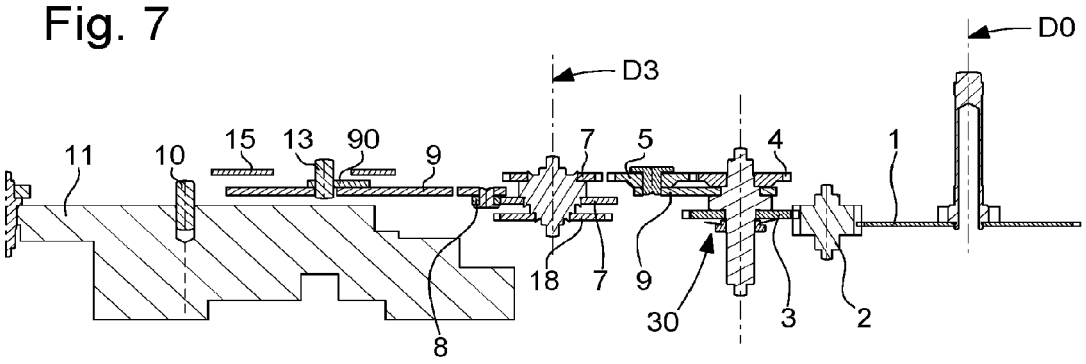
FIG. 7 is a cross-sectional view along section A-A of FIG. 1.
Figure 8:
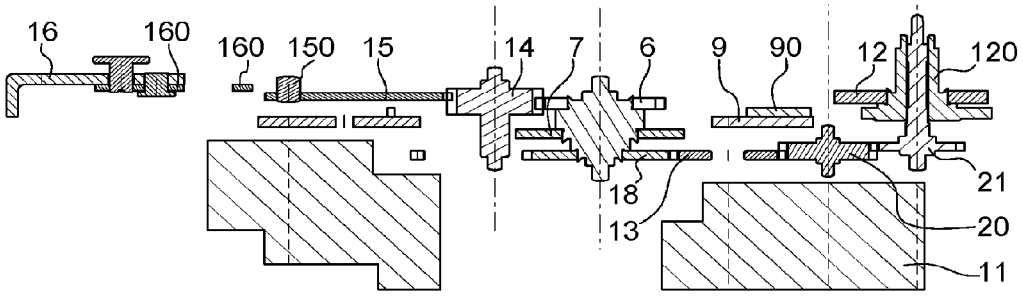
FIG. 8 is a cross-sectional view along section B-B of FIG. 1.
Figure 9:
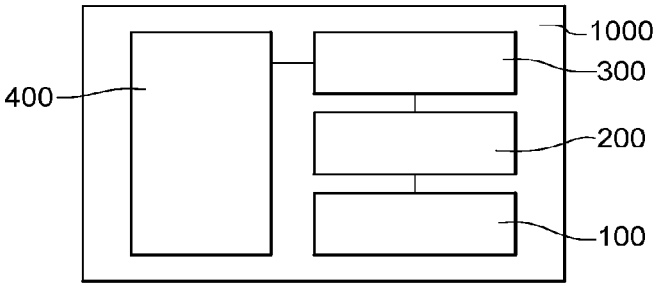
FIG. 9 is a block diagram representing a watch including a movement, a striking mechanism and an alarm mechanism to which is added a snooze timer mechanism according to the invention.

Advantageously, to avoid straining the going train, the fourth intermediate wheel 4 is driven by the third intermediate wheel 3 by means of a friction spring 30 as seen in FIG. 7. When rack 15 is stopped against duration cam 12, the countdown is started.

Cannon-pinion 1 drives release cam 7 in the opposite direction. Roller 8 is forced against release cam 7 and will roll until it drops into notch 70 of release cam 7, thereby driving hammer lever 9, which will release the actuator or hammer 11, and release disengagable wheel 5.

The alarm will then sound again and the snooze function will be disconnected from the movement.

Figure 3:
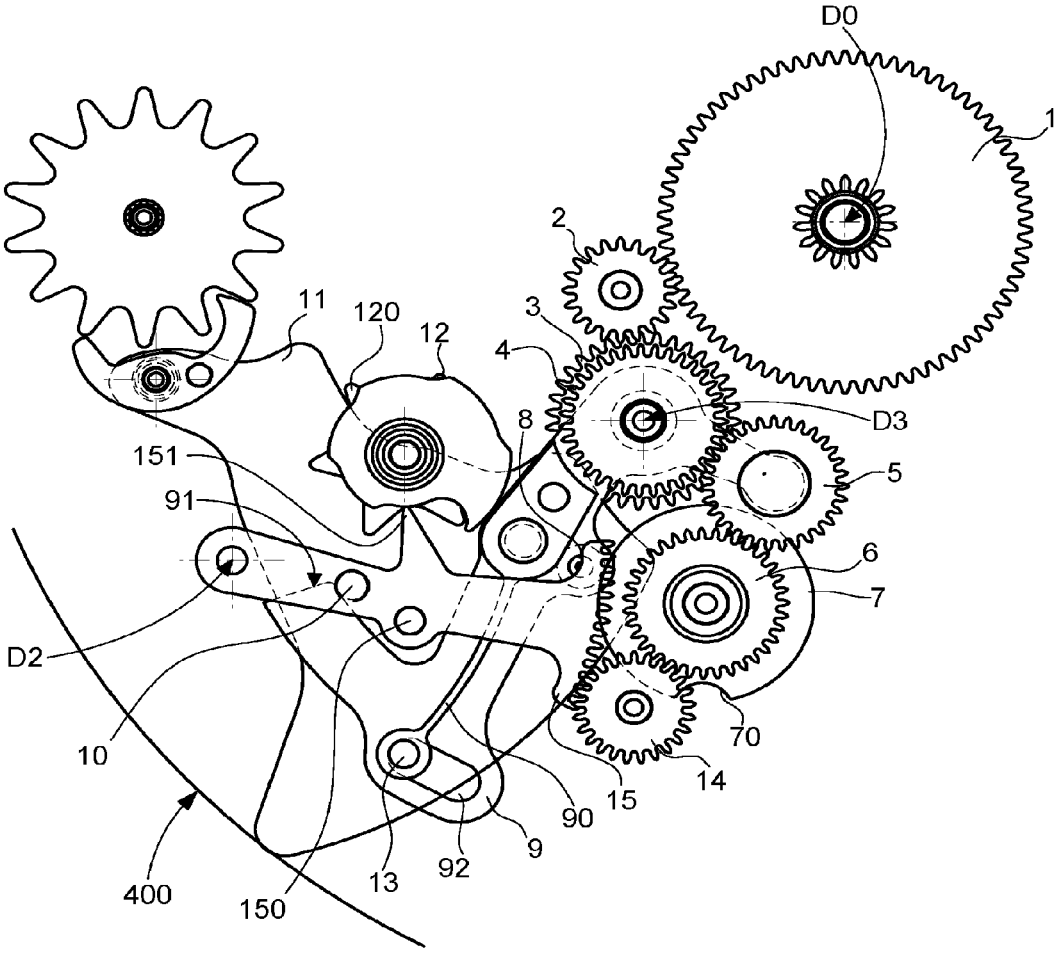
FIG. 3 represents a part of the mechanism of FIG. 1 when the snooze function is actuated.

FIG. 3 illustrates the activated snooze function.

Duration cam 12, according to the invention, allows the user to set the snooze time duration. Indeed, it preferably comprises several stages, which each correspond to a basic duration, specific to the profile of duration cam 12. These predefined basic durations are not necessarily constant; they may be, in particular, increasingly reduced or vice versa.

Duration cam 12 is advantageously coupled to a star 120 moved by the second control means. The second control means comprise a setting system, not shown in full in the Figures, which represent only a star 120 comprised in the second control means, which those skilled in the art may envisage operating by means of any conventional mechanism: a second push-piece, knurling-roller, pull-out piece or other element. Naturally, the second control means may comprise, instead of star 120, an equivalent component for performing this function.

In the particular and non-limiting example illustrated, each stage of duration cam 12 corresponds to a step of 5 minutes' duration. Release cam 7 rotates by a smaller or greater angle, depending on the stage on which beak 151 of rack 15 is stopped. The snooze time duration is thus shorter or longer. Duration cam 12 is positioned by star 120, onto which a hand or a disc can easily be pressed, so as to display the setting of the snooze time duration.

In another variant not illustrated in the Figures, duration cam 12 is a smooth cam, for small adjustments to the snooze time duration, for example on the order of a minute.

A display wheel 21 is connected to release cam 7 by series of intermediate wheels 20, 19, 18. By pressing a hand or a disc onto display wheel 21, it is easy to display a snooze activation indicator, or a countdown of the remaining minutes before the alarm sounds again, when the snooze function is activated.

In the non-limiting embodiment illustrated by the Figures, display wheel 21 is coaxial with duration cam 12 and star 120, and the two displays can thus cooperate with the same dial or indicator.

In order to avoid reactivating the snooze function while the latter is still operating, a safety feature is provided: when the snooze function is deactivated, control click 160 moves past a lever jumper pin 13, fixed to the end of a lever jumper 90 integral with hammer lever 9, and movable in an oblong hole 92 in rack 15, and control click 160 pushes rack pin 150.

When hammer lever 9 is raised, this lever jumper 90 positions lever jumper pin 13.

If the user presses on push-piece 161 to actuate control lever 16, against a spring 17, control click 160 moves against lever jumper pin 13, pivots about an axis D5 with respect to control lever which carries said click, and moves past rack pin 150. The pivoting of control click 160 with respect to control lever 16 is limited by a pin 166 moving in an oblong hole 167, and returned to one end of oblong hole 167 by end 170 of spring 17, so that it tends to permanently push control click 160 towards jumper 15.

Figure 4:
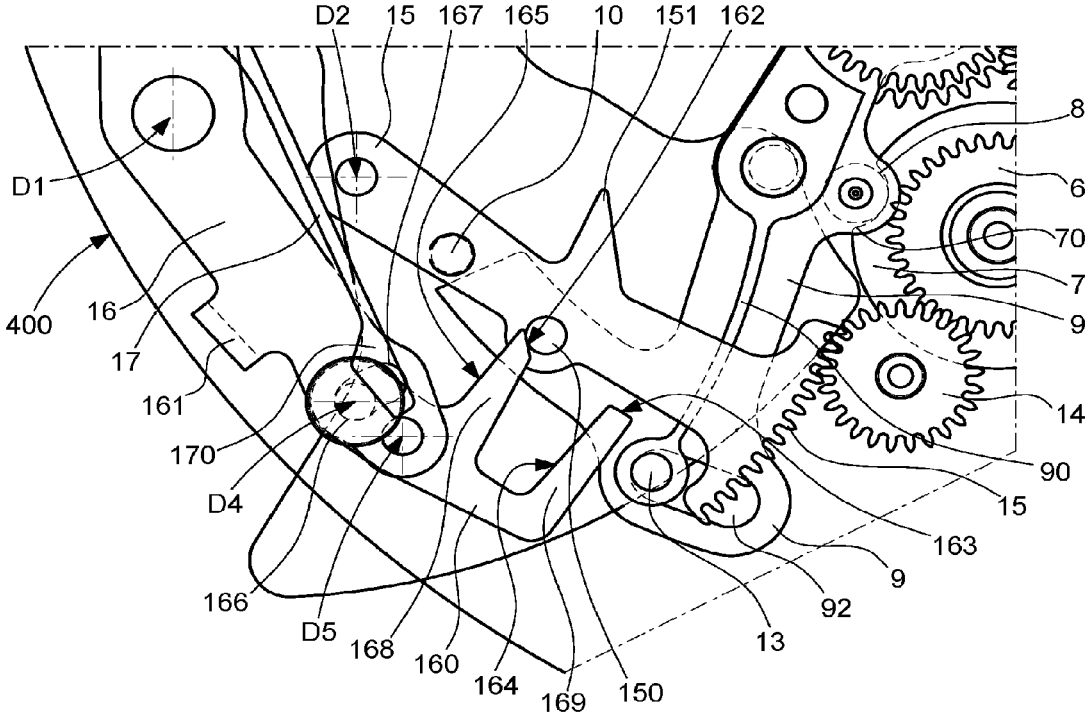
FIGS. 4 to 6 show a detail relating to the mobility of a control click, comprised in the mechanism according to the invention.
Figure 5:
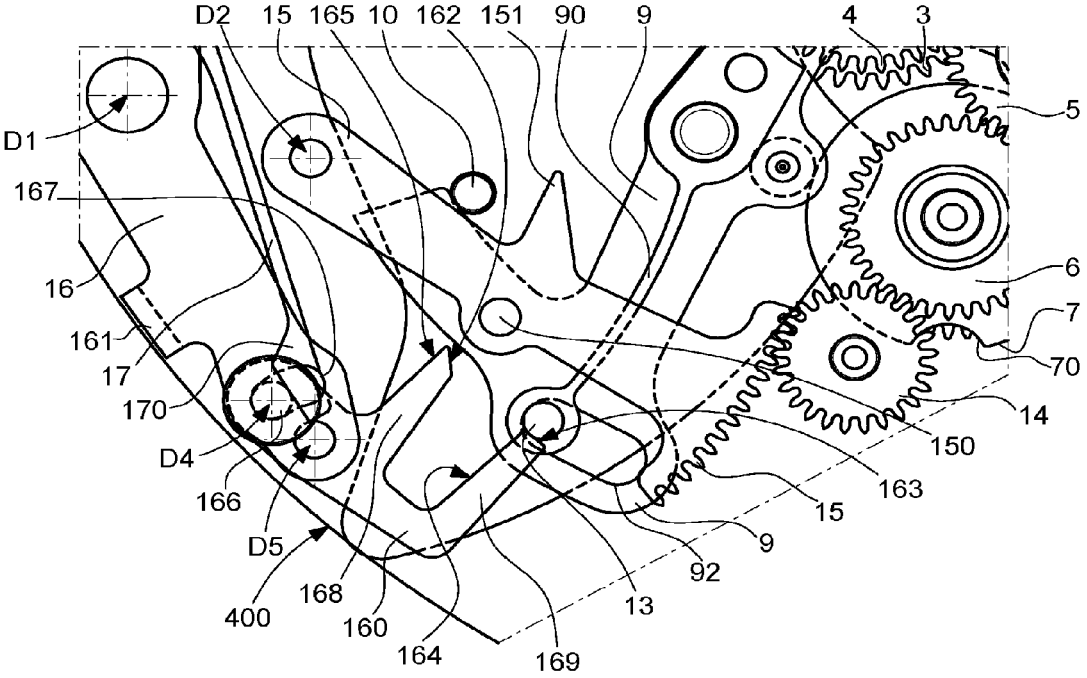
Figure 6:
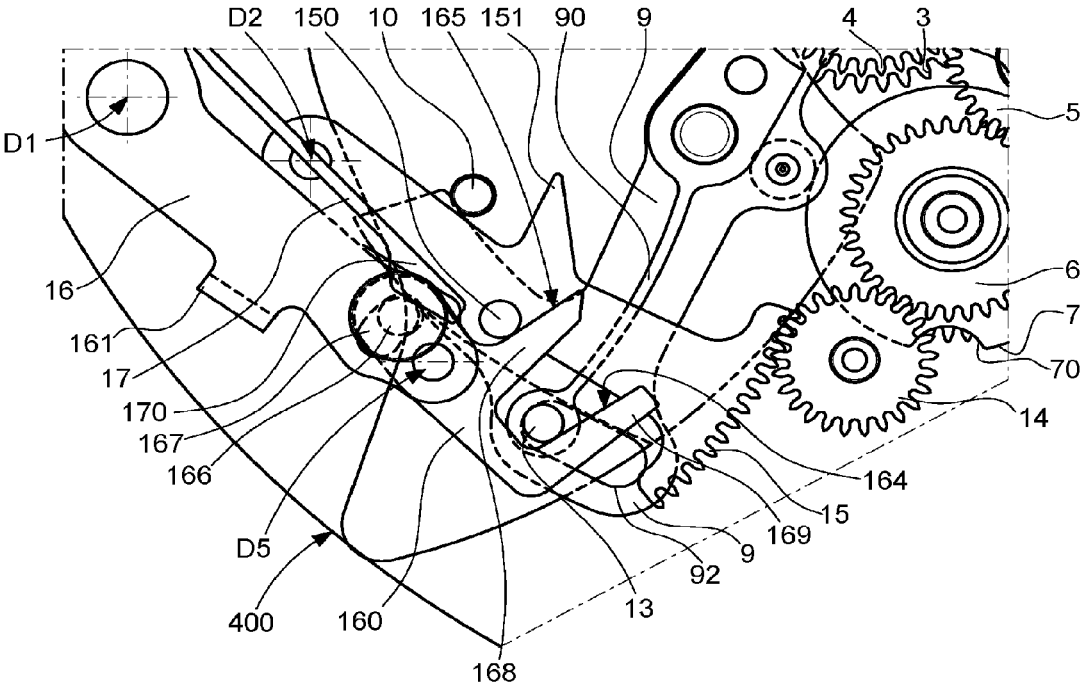

FIGS. 4 to 6 illustrate the mobility of control click 160 which includes a fork with two arms, the first arm 168 comprising first end bearing surface 162, arranged to be able to cooperate in abutment with rack pin 150, as seen in FIG. 4, and the second arm 169 comprising second end bearing surface 163, arranged to be able to cooperate in abutment with lever jumper spring 13, as seen in FIG. 5, this second arm also including a side surface 164 for limiting the travel of lever jumper spring 13, as seen in FIG. 6, which corresponds to the retraction of the control click.

The snooze function can only be restarted when hammer lever 9 is in a rest position, and therefore only when the snooze function is deactivated.

Beforehand, in this rest position, click 160 is in the position of FIG. 4. Roller 8 is positioned in that case in notch 70 of release cam 7. A thrust motion imparted to push-piece 161 causes first bearing surface 162 to push on rack pin 150, and the particular inclined shape given to this first bearing surface 162 causes rack pin 150 to slide into the hollow of click 160, inside the U delimited by its two arms.

At the articulation between first control lever 16 and click 160, pin 166 of click 160 is movable in oblong hole 167 of first control lever 16. This pin 166 tends to pivot anti-clockwise, under the action of spring 17 which bears thereon, pin 166 then moves to the bottom of oblong 167, into a position where the connection between first control lever 16 and click 160 is almost a rigid connection, due to the butting of pin 166 in oblong hole 167.

Rack 15 is then released and can drop. Release cam 7 pivots. Hammer lever 9 is raised at the same time that first control lever 16 falls.

Pin 13 of lever jumper 90 then moves against the end of oblong hole 92 of release lever 9. This means that click 160 can continue to be pushed. Lever jumper 90 is stressed, this is the member that ensures that the snooze mechanism operates safely without breakage when it positions lever pin 13.

FIG. 5 corresponds to the position where the user can start timer mechanism 100. Lever jumper 90 is dimensioned to be stiffer than spring 17. Consequently, click 160 can pivot about axis D5 in the clockwise direction, under the thrust of lever pin 13 driven by jumper 90. Pin 166 then tends to go to the other side of oblong hole 167. The first arm of click 60, which carries first bearing surface 162, moves past the pin.

The retracted position of the click of FIG. 6 is then reached, wherein lever pin 13 is bearing on the inner side 164 of the second arm of the click. Rack pin 150 is behind the outer side surface 165 of the first arm of click 60, and theoretically remote from this outer surface 165.

The invention also concerns a watch 1000 comprising a timepiece movement 400 cooperating with a striking mechanism 300 and an alarm mechanism 200 arranged to control the motion of at least one mechanical actuator 11, watch 1000 comprising such a timer 100 for setting a snooze time.

The invention has the advantage of not wasting torque. Indeed, roller 8 permanently rolls on release cam 7, except when it cooperates with its notch 70. The engaging force occurs under pressure from the user, and thus does not use any energy resource internal to the watch. When roller 8 enters notch 70, the disengaging force is provided by hammer lever 9, which disengages the assembly and returns it to the rest position.

What is claimed is:

1. An alarm mechanism arranged to control the motion of at least one mechanical actuator cooperating with a striking mechanism controlled by a timepiece movement, and comprising a timer for setting a snooze time, wherein said timer is entirely mechanical and comprises first control means able to be actuated at a first moment by a user during the playing of an alarm chime in order to disengage said actuator and momentarily stop said alarm chime, and wherein said timer includes mechanical timing means arranged to automatically cause said alarm chime to play again at a second moment, after a predefined duration from said first moment, wherein said timer includes a release cam indirectly controlled by said first control means and which is arranged to control the pivoting of a hammer lever, comprised in said timer, which hammer lever, depending on the angular position thereof, releases or locks said actuator to allow or respectively prevent the playing of an alarm chime.

2. The alarm mechanism according to claim 1, wherein said first control means comprise a first control lever arranged, during the pivoting thereof under the action of a user, to control the pivoting of a rack arranged to drive said release cam.

3. The alarm mechanism according to claim 2, wherein said first control lever comprises an articulated control click returned by at least one spring, said control click comprising a first end bearing surface arranged to push a rack pin comprised in said rack to cause said rack to pivot, and a second end bearing surface arranged to push a pin comprised in a lever jumper that is integral with said hammer lever, said hammer lever includes an oblong hole in which is movable said pin, said pin tends to push back said control click outwardly of said movement into a position wherein said first control means are able to be operated by the user.

4. The alarm mechanism according to claim 3, wherein said control click includes, between said first end bearing surface and the articulation with said control lever, a side bearing surface receiving and supporting said rack pin, and, between said first end bearing surface, and said second end bearing surface, a recess allowing retraction of said control click when said first control means are operated in the end of travel position by the user.

5. The alarm mechanism according to claim 3, wherein said first control lever is articulated to said control click by means of a pin movable in an oblong hole, and returned to the exterior of said movement by said spring.

6. The alarm mechanism according to claim 1, wherein said hammer lever carries a disengagable wheel meshing with a train of said timepiece movement via a friction spring, said disengagable wheel being capable of occupying a first position of mesh with a release cam wheel integral with said release cam, said first position of mesh corresponding to an angular position wherein said hammer lever locks said actuator, and a second out-of-mesh position with said release cam wheel, said out-of-mesh position corresponding to an angular position wherein said hammer lever allows said actuator free passage.

7. The alarm mechanism according to claim 1, wherein said timer includes second control means able to be actuated by a user to set said predefined duration.

8. The alarm mechanism according to claim 2, wherein said rack comprises a beak, which is arranged to bear on a cam track comprised in a duration cam, which preferably has a plurality of tracks each corresponding to a particular time duration enabling the user to set said predefined duration.

9. The alarm mechanism according to claim 8, wherein said duration cam is coupled to a star moved by said second control means.

10. The alarm mechanism according to claim 9, wherein said star carries a hand or a disc for displaying the setting of the time duration.

11. The alarm mechanism according to claim 8, wherein a display wheel connected to said release cam by a train, carries a hand or a disc for displaying activation of the timer or a countdown of the remaining time before the next alarm chime when the timer function is activated.

12. A watch comprising a timepiece movement cooperating with a striking mechanism and an alarm mechanism according to claim 1.

* * * * *